United States Patent [19]

McLane

[11] 4,022,356

[45] May 10, 1977

[54] METAL VALVE FOR BATTERY GRID CASTING MACHINE

[75] Inventor: Jack E. McLane, Port Huron, Mich.

[73] Assignee: Wirtz Manufacturing Company, Inc., Port Huron, Mich.

[22] Filed: July 21, 1976

[21] Appl. No.: 707,300

[52] U.S. Cl. ..... 222/509; 222/152; 222/524; 222/601

[51] Int. Cl.[2] ..... B67D 5/06

[58] Field of Search ..... 222/509, 522, 524, 501, 222/152; 251/340, 343, 347; 137/437, 449, 240

[56] References Cited

UNITED STATES PATENTS

| | | | |
|---|---|---|---|
| 2,745,153 | 5/1956 | Burkett | 222/152 X |
| 3,310,851 | 3/1967 | Stiteler | 222/509 X |

*Primary Examiner*—Stanley H. Tollberg

*Assistant Examiner*—Hadd Lane

*Attorney, Agent, or Firm*—Barnes, Kisselle, Raisch & Choate

[57] ABSTRACT

A valve for dispensing a predetermined amount of molten lead to the mold of a battery grid casting machine has two tubular housings arranged in telescoping relation with their axes extending vertically. The upper housing is fixed and has a feed line for molten metal connected thereto. The lower housing is vertically movable and has a molten metal discharge line extending therefrom. A ball valve member is retained on a pedestal in the lower housing and is arranged to seal with an annular valve seat in the upper housing to control the flow of metal in response to vertical movement of the lower housing. The ball valve is retained in axial alignment with the valve seat by a plurality of circumferentially arranged fingers on the upper housing which surround and extend downwardly beyond said seat.

11 Claims, 3 Drawing Figures

METAL VALVE FOR BATTERY GRID CASTING MACHINE

This invention relates to battery grid casting machines, and, more particularly, to a valve mechanism for periodically dispensing a predetermined amount of molten metal into a mold filling ladle.

In U.S. Pat. No. 3,877,620, the assignee of which is the same as the assignee hereof, there is disclosed a valve for dispensing a predetermined amount of molten metal into a mold filling ladle during each cycle of operation of a battery grid casting machine. Although the valve disclosed in said patent represents a substantial improvement over previous lead dispensing valves used in battery grid casting machines, experience with the patented valve has shown that with some modifications better performance can be obtained with even less maintenance problems.

Accordingly, the present invention has for its object the provision of a molten metal valve of the type disclosed in the aforesaid patent which is designed to operate more efficiently and with less maintenance.

More specifically, the valve of the present invention embodies a fixedly supported upper housing and a vertically movable lower housing telescopically engaged therewith. The upper housing is connected to a source of molten metal, such as a lead pot, and the lower housing discharges into a mold filling ladle. The two housings are dimensioned to have a slight clearance between their telescoping side walls to compensate for possible distortion and misalignment due to heat and assembly tolerances. A valve seat is mounted in the upper housing for cooperation with a spherical ball valve member supported on a flat pedestal in the lower housing to control the flow of molten metal through the valve. A plurality of downwardly extending, circumferentially spaced fingers on the upper housing form a cage closely surrounding the ball valve member in fixed relation thereto so that it is at all times in a self-aligning position relative to the vavle seat.

Other objects, features and advantages of the present invention will become apparent from the following description and accompanying drawing, in which.

Figures 1, 2, 3:
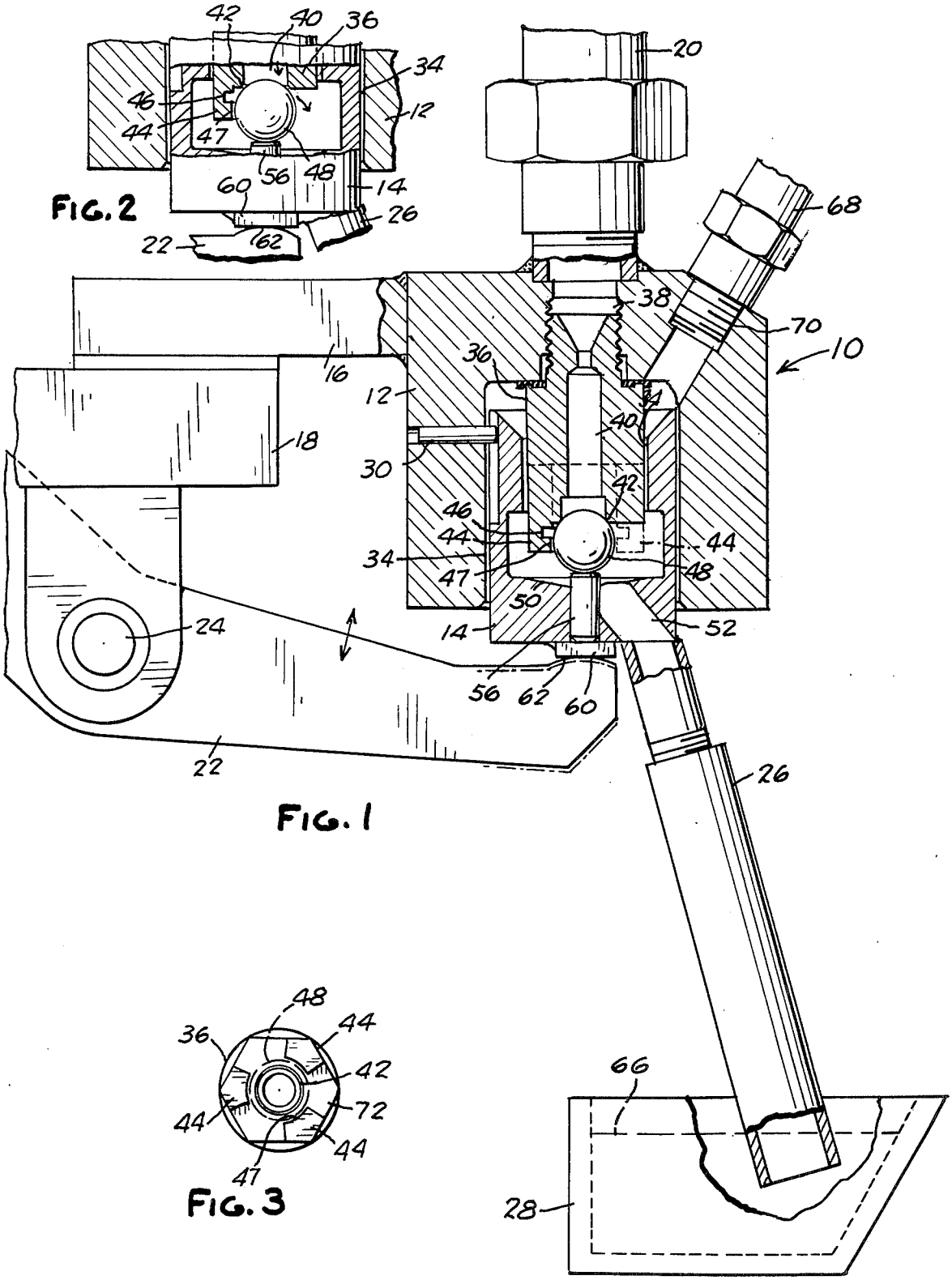
FIG. 1 is a fragmentary view, partly in section, of a battery grid casting machine and showing the valve of this invention in the closed position.
FIG. 2 shows the valve in open position.
FIG. 3 is a bottom view of a portion of the valve.

Referring to FIG. 1, the valve of the present invention, which is generally designated 10, is similar in many respects with the valve disclosed in U.S. Pat. No. 3,877,620. The valve includes an inverted cup-shaped upper housing 12 and a cup-shaped lower housing 14 which are telescopically arranged as shown. The upper housing 12 is fixedly supported as by bracket 16 on a stationary frame member 18 of the battery grid casting machine. A conduit 20 extends from a lead pot (not shown) to upper housing 12, a pump being provided to deliver the lead to the valve. The lower housing 14 is supported by a lever 22 which is pivoted on a fixed horizontal axis as at 24. Lever 22 is pivoted slightly during each cycle of operation of the battery grid casting machine so as to deliver a predetermined quantity of molten lead through an outlet conduit 26 to a mold filling ladle 28. The amount of lead discharged to ladle 28 during each cycle of operation of the machine depends upon the extent to which the lever 22 is pivoted in a clockwise direction as viewed in FIG. 1 and the length of time that the lever is so pivoted.

As shown in FIG. 1, housings 12 and 14 are each of generally cup-shape. Housing 14 is telescoped upwardly into the open lower end of housing 12 and is guided for rectilinear movement therein by a pin 30 which engages in a vertical groove 32 on housing 14. The inner diameter of housing 12 is slightly larger than the outer diameter of housing 14 so that there is a slight clearance 34 between the side walls of these two housings; this clearance is preferably on the order of about .010 to 0.015 inches.

Within upper housing 12 there is arranged a fitting 36 which is threaded into the opening 38 in the top wall thereof to which the inlet conduit 20 is connected. Fitting 36 has a central passageway 40 which terminates at its lower end in an annular valve sear 42. The lower end of fitting 35 is hexagonally shaped and formed with three downwardly extending fingers 44 which are spaced circumferentially apart equal distances around valve seat 42. As shown in FIGS. 1 and 2, each of the fingers 44 are radially undercut as at 46. The radially inner end faces 47 of fingers 44 are accurately ground to define segments of a cylindrical surface accurately concentric with the annular valve seat 42 and having a relatively close fit with a ball valve member 48. Ball valve member 48 is preferably formed of a ceramic material and is accurately ground and polished to spherical shape. The diameter of the cylindrical surface defined by faces 47 of fingers 44 is only about 0.010 inches larger than the diameter of ball valve member 48.

The cavity in lower housing 14 has a conically dished bottom wall 50, the lowermost portion of which is in communication with outlet conduit 26 through an outlet port 52. The bottom wall of lower housing 14 is centrally apertured as at 54 and a hard metal pin 56 is press fitted therein. The inner end of pin 56 is accurately ground with a flat surface 58 perpendicular to the axis of bore 40. A thin metal plate 60 welded to the central portion of the bottom face of housing 14 is engaged by the rounded nose 62 of lever 22 which supports housing 14 within housing 12.

Valve 10 is opened and closed by shifting lower housing 14 vertically. This is accomplished by pivoting lever 22 as indicated by the arrow in FIG. 1. The rounded nose portion 62 of lever 22 engages thin metal plate 60 so that, as the lever pivots, inner housing 14 is shifted vertically within housing 12, but is subjected to substantially no side thrust by the pivotal movement of lever 22. When lever 22 is pivoted downwardly housing 14 shifts vertically downwardly to unseat ball valve member 48 from valve seat 42. However, the extent of pivotal movement of lever 22 to open and close the valve is relatively small so that in the completely opened position of the valve (the position shown in FIG. 2), the inner faces 47 of fingers 44 are preferably still horizontally aligned with and engage ball valve member 48 at a horizontal diametrical plane through the center of the ball. The extent of pivotal movement of lever 22, and, consequently, the extent of vertical movement of ball 48 relative to valve seat 42 is controlled by threaded adjustment means for lever 22 which are not shown but which may be similar to the corresponding adjusting means shown in U.S. Pat. No. 3,877,620.

When lever 22 is rotated clockwise about the axis 24, lower housing 24 shifts vertically downwardly to the extent permitted by lever 22 and is retained in the lowered position for predetermined time period as determined by the setting of a timer (not shown) which controls the actuation of lever 22. During this interval of time molten metal in feed line 20 flows downwardly through passageway 40, discharges through valve seat 42, around ball valve member 48 and into the hollow lower housing 14. The inclined bottom wall 50 of housing 14 causes the molten metal to flow directly to outlet port 52 and into ladle 28 through outlet conduit 26. As shown in FIG. 1, the outlet of conduit 26 is always located below the level 66 of the molten metal in ladle 28. Air is thus prevented from entering the valve through outlet conduit 26. This will tend to prevent the accumulation of dross in the molten metal. The prevention of dross is substantially enhanced by the introduction of an inert gas to the space enclosed by housings 12,14 through a conduit 68 connected with a port 70 in upper housing 12. While a small amount of inert gas may escape from within the housings at the clearance space 34 between the housings, this amount is not substantial since, as pointed out above, the clearance space 34 only amounts to about 0.010 to 0.015 inches on a side.

Although the clearance space 34 is of the magnitude mentioned above, it is sufficient to compensate for any misalinment which may occur between housings 12,14 due either to heat or to assembly tolerances. It will be noted, however, that, regardless of this misalignment, ball valve member 48 is retained in accurate alignment with valve seat 42 by the radially inner faces 47 of the fingers 44 on fitting 36 which is fixed to the stationary housing 12. The clearance between faces 47 and ball valve member 48 is preferably only that required to permit the ball to move freely in a vertical direction. Thus, fingers 44 restrict movement of ball valve member 48 to a substantially vertical direction so that when lever 22 pivots upwardly in a counterclockwise direction pin 56 shifts ball valve member 48 vertically upwardly so as to engage valve seat 42 around its entire periphery and, thus, result in a perfect seal. The accumulation of any dross around valve seat 42 and between ball valve member 48 and fingers 44 is prevented by the undercuts 46 directly above the radially inner faces 47 of fingers 44 which provide relatively large flow passageways for the molten metal. It will be noted that the flow passageways 72 between circumferentially adjacent fingers 44 diverge in a radially outward direction and have a circumferential extent greater than the fingers themselves.

The undercuts 46 in combination with the inclined bottom wall 50 render the valve self-cleaning since the flow passageways are large and since there are no crevices of ledges on which dross or molten metal can collect and remain. In the event that it is required to disassemble the valve for servicing, this can be accomplished by merely shifting lever 22 to an out-of-the-way position so that housing 14 can be simply withdrawn downwardly from telescopic engagement with the upper housing 12. This can be done without the use of tools.

I claim:

1. A valve for dispensing molten metal to a mold filling ladle of a battery grid casting machine comprising upper and lower tubular housings having their central axes extending generally vertically in generally coaxially aligned relation, the lower end of said upper housing and the upper end of said lower housing being in open communication with one another and telescopically engaged, one of said housings being supported in fixed position on the machine and the other being mounted on the machine for vertical movement through a predetermined stroke, means for shifting said movable housing vertically, said upper housing having a bore therein which opens vertically downwardly, said bore terminating at its lower end in an annular valve seat which is generally coaxial with said upper housing, said valve seat being disposed below said upper end of said lower housing, an inlet conduit for molten metal connected with said bore, said lower housing having an upstanding pedestal therein, said pedestal having an upstanding pedestal therein, said pedestal having a generally flat upper end face lying in the plane perendicular to the axis of said housing, a spherical ball resting on said upper face of said pedestal, said upper housing having a plurality of at least three circumferentially spaced fingers extending downwardly beyond said annular valve seat, the radially innermost end face portions of said fingers defining a circle accurately concentric with said annular valve seat, said fingers extending downwardly so that the lower end portions thereof extend circumferentially around and radially confine the ball valve member, the circle defined by the innermost end face portions of said fingers having a diameter slightly larger than the diameter of the ball valve member move relatively toward each other the ball valve member readily aligns itself with the valve seat regardless of the misalignment between the two housings, means forming a molten metal outlet in said lower housing at a level below said pedestal whereby, when the movable housing is shifted vertically to unseat the ball, the molten metal flows downwardly by gravity through said outlet means.

2. A valve as called for in claim 1 wherein said radially innermost end face portions of said fingers have an axial extent at least slightly greater than the vertical stroke of the movable housing and are disposed to engage the ball valve member in a horizontal plane through the center thereof both when the valve is fully opened and fully closed.

3. A valve as called for in claim 2 wherein the radially inner end faces of said fingers define segments of a cylindrical surface concentric with the annular valve seat.

4. A valve as called for in claim 2 wherein said fingers are relieved in a radially outward direction at the vertically extending portions thereof between said valve seat and the radially innermost ends thereof.

5. A valve as called for in claim 1 wherein the radially innermost end portions of said fingers define a circle having a diameter only sufficiently larger than the diameter of the ball valve member to permit the latter to move freely in a vertical direction toward and away from said valve seat.

6. A valve as called for in claim 5 wherein the circle defined by the radially innermost end portions of said fingers has a diameter which is about 0.010 inches larger than the diameter of said ball valve member.

7. A valve as called for in claim 1 including a fitting extending downwardly within said upper tubular housing and having a central passageway which defines said bore, said valve seat being disposed adjacent the lower end of said fitting, said fingers extending downwardly from the lower end of said fitting around a circle spaced radially outwardly from said valve seat, the lower ends of said fingers projecting radially inwardly so that they are L-shaped in vertical section, the circumferential space between adjacent fingers forming molten metal passageways extending from said valve seat into said lower housing.

8. A valve as called for in claim 7 wherein said passageways diverge in a radially outward direction, the circumferential extent of said passageways being substantially greater than the circumferential extent of said fingers.

9. A valve as called for in claim 1 wherein the upper housing is fixed on the machine and the lower housing is vertically movable, said means for shifting the lower housing vertically comprising a lever pivoted on a horizontal axis, said lever having a free end underlying and supporting the lower housing, the free end of said lever being rounded and frictionally engaging the bottom face of the lower housing.

10. A valve as called for in claim 9 wherein the portion of the bottom face of the housing engaged by the free end of said lever is flat.

11. A valve as called for in claim 9 including guide means acting between said housings to prevent rotation of the lower housing relative to the upper housing.

* * * * *

UNITED STATES PATENT OFFICE
CERTIFICATE OF CORRECTION

PATENT NO. : 4,022,356
DATED : May 10, 1977
INVENTOR(S) : McLane, Jack E.

It is certified that error appears in the above-identified patent and that said Letters Patent are hereby corrected as shown below:

| | |
|---|---|
| Column 4, Lines 13 & 14 | Cancel "said pedestal having an upstanding pedestal therein," |
| Column 4, Line 28 | After "ber" insert -- so that when the valve seat and the ball valve member -- |

Signed and Sealed this
*twelfth* Day of *July 1977*

[SEAL]

*Attest:*

RUTH C. MASON
*Attesting Officer*

C. MARSHALL DANN
*Commissioner of Patents and Trademarks*